US008899918B2

(12) United States Patent
Weber et al.

(10) Patent No.: US 8,899,918 B2
(45) Date of Patent: Dec. 2, 2014

(54) PUMP

(75) Inventors: Wolfgang Weber, Eschwege (DE); Tobias Albert, Kraichtal (DE)

(73) Assignee: E.G.O. Elektro-Gerätebau GmbH, Oberderdingen (DE)

( * ) Notice: Subject to any disclaimer, the term of this patent is extended or adjusted under 35 U.S.C. 154(b) by 523 days.

(21) Appl. No.: 13/410,621

(22) Filed: Mar. 2, 2012

(65) Prior Publication Data

US 2012/0224961 A1 Sep. 6, 2012

(30) Foreign Application Priority Data

Mar. 4, 2011 (DE) ..... 10 2011 005 138

(51) Int. Cl.

| | |
|---|---|
| ***F04D 29/44*** | (2006.01) |
| ***F04D 9/00*** | (2006.01) |
| ***F04D 29/42*** | (2006.01) |
| ***F04D 29/58*** | (2006.01) |

(52) U.S. Cl.

CPC ..... *F04D 29/448* (2013.01); *F04D 9/003* (2013.01); *F04D 29/426* (2013.01); *F04D 29/588* (2013.01)

USPC ..... 415/211.2; 415/206

(58) Field of Classification Search

CPC ..... F04D 29/448; F05D 2240/12

USPC ..... 415/206, 211.2; 416/186 R

See application file for complete search history.

(56) References Cited

U.S. PATENT DOCUMENTS

| | | | | |
|---|---|---|---|---|
| 2,951,449 | A * | 9/1960 | Van Blarcom, Jr. et al. | 415/56.3 |
| 3,243,102 | A * | 3/1966 | McMahan | 415/208.2 |
| 5,450,868 | A * | 9/1995 | Young, Jr. | 134/111 |
| 2003/0235497 | A1 | 12/2003 | Meng | |
| 2010/0126534 | A1 | 5/2010 | Büsing et al. | |
| 2011/0097203 | A1 | 4/2011 | Shibata et al. | |

FOREIGN PATENT DOCUMENTS

| | | | |
|---|---|---|---|
| EP | 1 850 015 | A2 | 10/2007 |
| EP | 2 028 374 | A2 | 7/2008 |
| FR | 1533760 | A | 7/1968 |
| WO | WO 03005875 | A1 | 1/2003 |

OTHER PUBLICATIONS

European Search Report dated Dec. 13, 2013 in European Application No. P51127 EP.

German Office Action dated Mar. 2, 2012 in DE 10 2011 005 138.4.

* cited by examiner

*Primary Examiner* — Ninh H Nguyen

(74) *Attorney, Agent, or Firm* — Hope Baldauff, LLC

(57) ABSTRACT

A pump for a dishwasher has an impeller for conveying fluid, wherein it is formed as a centrifugal pump with the fluid to be conveyed being sucked-in in a central axial manner and flowing out in a radial manner. The impeller extends on a bottom surface above a pump base, wherein several fixed flow directing blades are arranged radially outside the impeller, said flow directing blades extending in a helicoidal manner with the pitch extending in the rotational direction of the impeller away from the pump base. At least one flow directing blade extends as far as up to the bottom surface of the impeller for picking up a circulating funnel or tube produced of fluid with air bubbles therein.

18 Claims, 5 Drawing Sheets

PUMP

SCOPE AND PRIOR ART

The invention relates to a pump, as is used in particular in domestic appliances such as a dishwasher or washing machine, the pump having an impeller for conveying fluid or water.

A corresponding pump is known from EP 2150165 A2, to which reference is hereby specifically made. It illustrates the fundamental method of operation of such a pump or centrifugal pump with an impeller very well both in principle and also in practice. In the case of this pump, there is the problem that has been observed in many cases that when air is sometimes sucked in with the fluid or water, air bubbles are rotated in the circuit by the impeller. Said air bubbles are frequently not discharged out of the pump or are not always able to be removed from the pump chamber such that they form a type of swirling, circulating funnel or tube. In this case they naturally impair the pumping capacity in a strongly negative manner.

OBJECT AND ACHIEVEMENT

The object underlying the invention is to create an aforementioned pump, by means of which disadvantages of the prior art may be avoided and, in particular, a pump being suitable for practice and is not susceptible to failure may be created.

This object is achieved by a pump with the features of Claim 1. Advantageous and preferred embodiments of the invention are the object of the further claims and are explained in more detail below. The wording of the claims is made to form the content of the description by means of explicit reference.

It is provided that, by way of the impeller, the centrifugal pump sucks in the fluid or water to be conveyed centrally and in an axial direction and discharges it or conveys it out of the impeller again in a radial manner. The fluid to be conveyed then circulates in the pump chamber until it once again flows approximately in the radial direction out of the pump chamber and out of the pump overall. The impeller, in this case, extends by way of a bottom surface above a pump base, beneath which is frequently located the drive motor, on the axle of which sits the impeller.

According to the invention, one or several flow directing blades are arranged radially outside the impeller, said flow directing blades extending in a helicoidal manner with a pitch extending in the rotational direction of the impeller away from the pump base. At least one flow directing blade, in this case, extends as far as up to the bottom surface of the impeller or as far as up to the vicinity thereof, in an advantageous manner at a maximum spacing of 5 mm, in a particularly advantageous manner at a maximum spacing of 3 mm or even only 1 mm. One flow directing blade or above all precisely the downwardly extending flow directing blade can cause the circulating fluid and in particular also the afore-described circulating funnel or tube of water with a plurality of air bubbles therein to be picked up quasi on the bottom surface of the impeller on the pump base and, by means of the pitch in the rotational direction of the impeller, to be conveyed away from the pump base and toward the discharge port out of the pump. Whilst the additional flow directing blades only influence or improve the conveying of water without air inclusions or the performance of the pump in a slight manner, the described aerating action is above all very advantageous and very pronounced. Several flow directing blades can extend downward far enough for picking-up and conveying away fluid mixed with air bubbles. In practice, however, it has been shown that just one single flow directing blade shows a good result and possibly is just sufficient.

In an advantageous development of the invention, the at least one downwardly drawn flow directing blade extends not only as far as up to the bottom surface of the impeller, but even at least as far as just in front of the pump base, in an advantageous manner at a maximum spacing of 5 mm, in a particularly advantageous manner a maximum spacing of 3 mm or even only 1 mm. It can possibly even extend as far as up to the pump base and abut against said pump base in a resilient manner. The named picking-up action is then the maximum.

In an advantageous manner in this case, the flow directing blades are stationary or are arranged fixedly in the pump chamber, whilst the impeller rotates. However, this does not exclude that the flow directing blades may also be removed out of the pump chamber or can be mounted by insertion as a separate part.

The at least one flow directing blade is arranged in an advantageous manner on a circumferential carrier ring extending substantially radially outside an upper region of the impeller, in such a manner that it does not disturb the fluid to be conveyed flowing out of the impeller in the radial direction. The advantage of such a carrier ring with a flow directing blade thereon is that only one single part has to be produced, inserted into the pump chamber and fixed therein. The carrier ring does not cause any problem at the named position in the upper region of the impeller. The afore-described at least one flow directing blade, which projects as far as up to the bottom surface of the impeller or as far as up to the pump base, can then protrude in the axial direction beyond the carrier ring. This means that it has to be self-supporting and no longer fastened on the carrier ring or positioned by means of said carrier ring. However, by developing the flow directing blade in a corresponding sturdy manner this does not present a problem.

As it has been described beforehand that it is actually sufficient for one single flow directing blade to extend as far as up to the bottom surface of the impeller or as far as up to the pump base, although more are able to be provided in total, it is deemed to be sufficient for only said one flow directing blade to protrude beyond the carrier ring or to stand out from said carrier ring.

In the case of one single flow directing blade it is also possible to dispense with the carrier ring if said blade runs around the impeller by more than 180° and is able to be held in a positionally stable manner in this way. In an advantageous manner, it has a complete revolution about the impeller.

As has been explained beforehand, two or a maximum of three flow directing blades are deemed to be sufficient in practice. In the case of more than one flow directing blade, said flow directing blades in this case can go around the impeller less than 180°. This is preferably less than 160°, but more than 90°. This applies in particular to a flow directing blade extending as far as up to the bottom surface of the impeller or as far as to just before or as far as up to the pump base. A further flow directing blade which is only provided on the aforementioned carrier ring can run around approximately 90° or somewhat less.

In a further development of the invention, it is deemed to be advantageous for the at least one flow directing blade to have an increasingly steep ascending angle as it extends away from the pump base. The result of this is that the troublesome funnel or tube produced from fluid to be conveyed and circulating water bubbles is removed from the pump base at a rather flat angle and also afterwards the entire fluid flow is guided increasingly in the axial direction. If this is effected once in a partial manner, the conveying-out can be accelerated or reinforced by means of an increasingly steeper angle. In this case it can be provided that in the case of a circulation of a flow directing blade of approximately 90° around the carrier ring, its entire axial extension is covered, that is to say from a bottom edge to a top edge.

The advantage of an angle that ascends in the circumferential direction of the flow directing blade is also that the speed component also increases in the axial direction, that is to say also toward the discharge port out of the pump. The conveying action out of the pump is improved in this manner.

In another further development of the invention it can be provided that the impeller is closed at its bottom surface or also at its top surface. An upper cover can also be provided in an advantageous manner on the top surface.

The afore-described carrier ring for the at least one flow directing blade does not cover a side radial discharge port of the impeller between the upper cover and the bottom surface. Only the flow directing blade extending as far as up to the bottom surface of the impeller or as far as to just in front of the pump base is located here. As, as also described in the aforementioned EP 2150165 A2, the impeller is usually pulled upward in the manner of a hat on its top surface by way of the upper cover, this region suffices for the provision or fastening of the carrier ring.

In a further development of the invention, a pump base region can be pulled upward radially outside the impeller, that is to say away from the pump base or from the motor located underneath, and in this case can extend in an angled manner at an increasing radial spacing to the impeller. The flow directing blade extending as far as up to the bottom surface of the impeller can then extend at a slight spacing to the inclined pump base region or in an advantageous manner can even abut against said pump base region. By means of a resilient abutment, a quasi gap-free transition can be created for improved removal of the air bubbles.

In a further development of the invention, a free inflow section of the flow directing blade, extending as far as up to the bottom surface of the impeller and also extends downward, can be pointed or tapered. A point or taper can be provided in an approximately uniform manner and can extend from a maximum width on the attachment on an aforementioned carrier ring as far as just to the point on the free end of the inflow section in the vicinity of the bottom surface of the impeller or abutting against the pump base.

This means that it is possible for the flow directing blade or its inflow section, quasi at a somewhat radial spacing to the impeller, to abut against the pump base or the wall radially outside the impeller over a large part of the cross section of the pump chamber. This means that precisely as good a removal of air bubbles as possible is possible or rather no undercuts or other cavities are formed in which the air bubbles may become trapped.

In an advantageous development of the invention it can be provided that the flow directing blade, which protrudes beyond the carrier ring and extends as far as up to the bottom surface of the impeller or abuts against the pump base, is provided in a resilient manner. This can be by way of a certain spring loading. The afore-described inflow section is suitable in particular for this purpose.

In an advantageous further development of the invention it can be provided that a flow directing blade not only extends toward the pump base over the carrier ring to pick up the air bubbles in the best possible way, but also extends in the other axial direction. To this end, it is possible to provide a free-standing diverting section which, for example, directly guides the fluid to be conveyed or a mixture of fluid to be conveyed and air bubbles as far as up to the vicinity of a discharge port out of the pump chamber. In this way it is also possible to predetermine how often the fluid to be conveyed circulates in the pump chamber before it flows out of the pump.

In an advantageous development of the invention, the flow directing blade can be provided such that it extends only halfway as far as up to an outer wall of the pump chamber to be filled by fluid to be conveyed. This can ensure that the conveying action desired by the flow directing blade is achieved. If the outer chamber wall is heated, said heating action is not impaired in this way. The at least one flow directing blade extends radially inward outside the impeller. The flow directing blade on the carrier ring extends somewhat above it. So that said carrier ring does not make the pump chamber unnecessarily smaller, it should extend as close as possible to an inner wall of the pump chamber or should abut against said inner wall. Said inner wall usually consists of a tubular section which, on the one hand, forms the central axial intake for the fluid to be conveyed and consequently extends in the vicinity of the upper surface of the impeller, then widens somewhat and quasi inverts outward and reverses direction and then extends once again to the pump cover or to the upper surface of the pump chamber. In addition, in the event of the pump having the named heating on the outside of the pump chamber, the action thereof remains as unimpaired as possible. The carrier ring, therefore, neither disturbs the water flow on the heating nor reduces in any way the action thereof.

These and further features also proceed from the description and the drawings aside from the claims, the individual features being provided in each case on their own or as a plurality in the form of subcombinations in the case of an embodiment of the invention and in other areas and being able to represent advantageous designs which are patentable in their own right for which protection is sought in this case. The division of the application into individual sections as well as intermediate headings does not restrict the universality of the statements made therein.

BRIEF DESCRIPTION OF THE DRAWINGS

Exemplary embodiments of the invention are shown in a schematic manner in the drawings and are explained below in more detail. In the drawings.

DETAILED DESCRIPTION OF THE EXEMPLARY EMBODIMENTS

Figure 1:
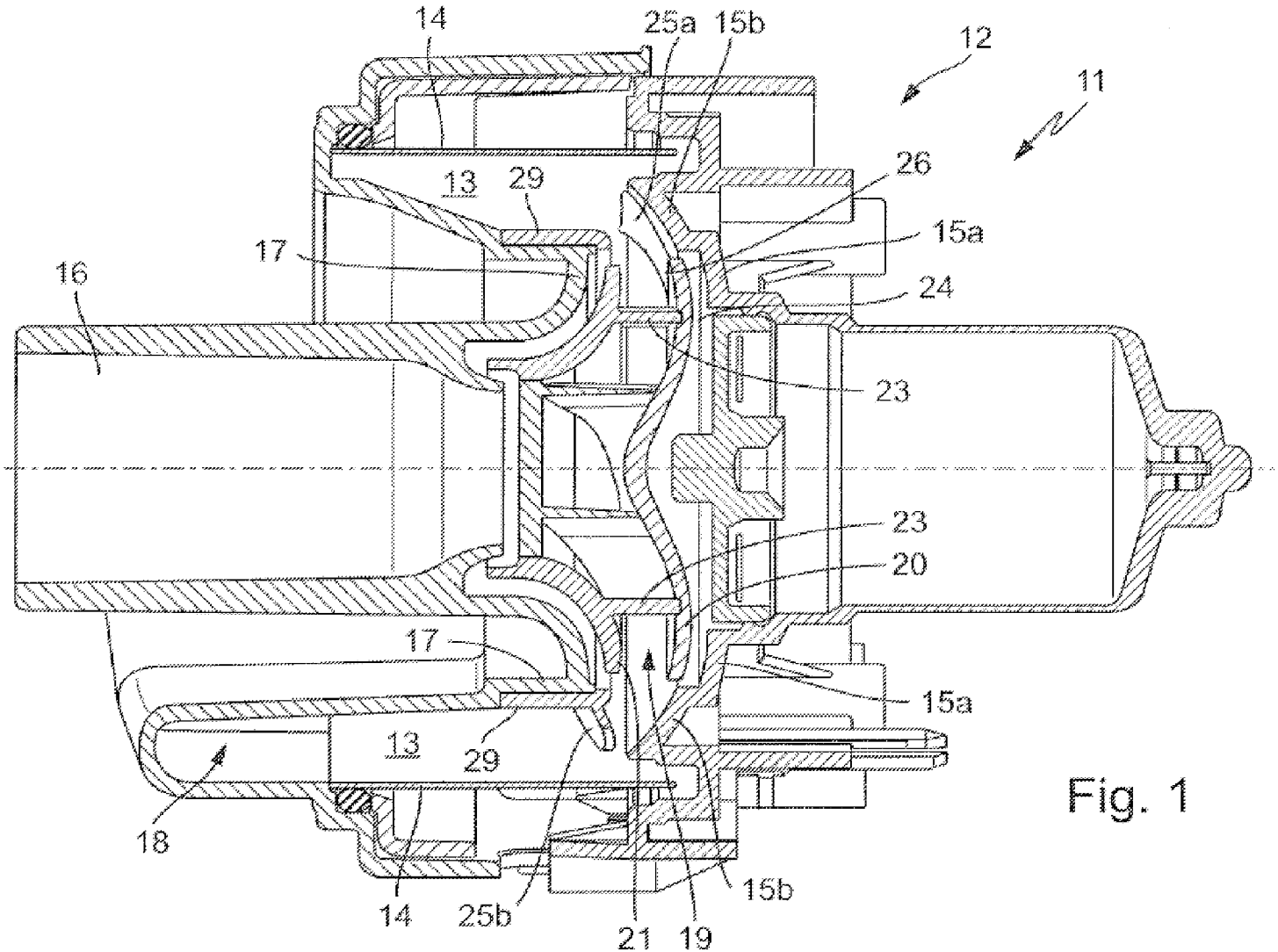
FIG. 1 shows a side longitudinal section through a pump according to the invention.

FIG. 1 shows a side longitudinal section of a pump 11 according to the invention with a pump housing 12 in which is located a pump chamber 13 with an outer chamber wall 14. A design of this type, which is usual per se, of a so-called radial pump is known, for example, from EP 2150165 A2.

In addition, a pump base with an inner pump base 15*a* and an outer pump base 15*b* are provided on the pump housing 12 along with a central axial tubular intake port 16 which merges into a pump cover 17. The latter, in its turn, merges into an inner wall, which leads to a side discharge port 18.

The intake port 16 leads to an impeller 19, which is mounted in a usual manner above the pump base 15. Said impeller is provided as a closed impeller 19 with a bottom impeller disk 20, a top impeller disk 21 and primary directing blades 23 in between. It can be seen in FIG. 1 that the impeller 19, by way of its bottom impeller disk 20, extends just above the inner pump base 15*a* and a gap 24 is provided here. Said gap 24 serves the purpose of balancing out the axial play of the impeller 19 mounted on a shaft of a pump motor.

Between the inner pump base 15*a* and the outer pump base 15*b* there is arranged a step, which lies quasi just outside the bottom impeller disk 20. It can be seen that the outer pump base 15*b* imitates approximately the convexity or curvature of the bottom impeller disk 20. This serves for an improved fluid flow.

To convey fluid in the pump 11, the impeller 19 rotates in a clockwise manner when seen from the left-hand side in the longitudinal direction and conveys fluid into the pump chamber 13 in a radial manner and with a speed component in the circumferential direction. The chamber wall 14 is provided in a manner not shown as a heating element or is heated such that the fluid flowing along on its inner side on the way to the discharge port 18 flows along thereon with several rotational movements and is heated. Reference is also made to the aforementioned EP 2150165 A2 to this end.

A carrier ring 29 extends around the cylindrical section of the pump cover 17 radially outside and at the level of the top impeller disk 21. For fixing, said carrier ring can be slipped onto the pump cover 17 with a press fit or alternatively it can be latched or bonded thereto. In the axial direction it only protrudes slightly to the right beyond the pump cover 17. As becomes clear from comparison with the following FIGS. 2 to 5, two flow directing blades 25*a* and 25*b* are arranged or integrally molded on the outside of the carrier ring 29. Of the flow directing blade 25*a*, substantially only its protruding region and its free end 26*a* are shown, which corresponds to the inflow section named above. The flow directing blade 25*a* abuts by way of the protruding region substantially against the outer pump base 15*b* as far as toward its free end 26*a*, half of which is covered here by the bottom impeller disc 20. The other flow directing blade 25*b* does not protrude beyond the carrier ring 29 in the axial direction, as can be seen in FIG. 1. It can also be seen that the width of the flow directing blade 25*b* amounts, approximately, to half the spacing between the carrier ring 29 and the heated chamber wall 14.

Figure 2:
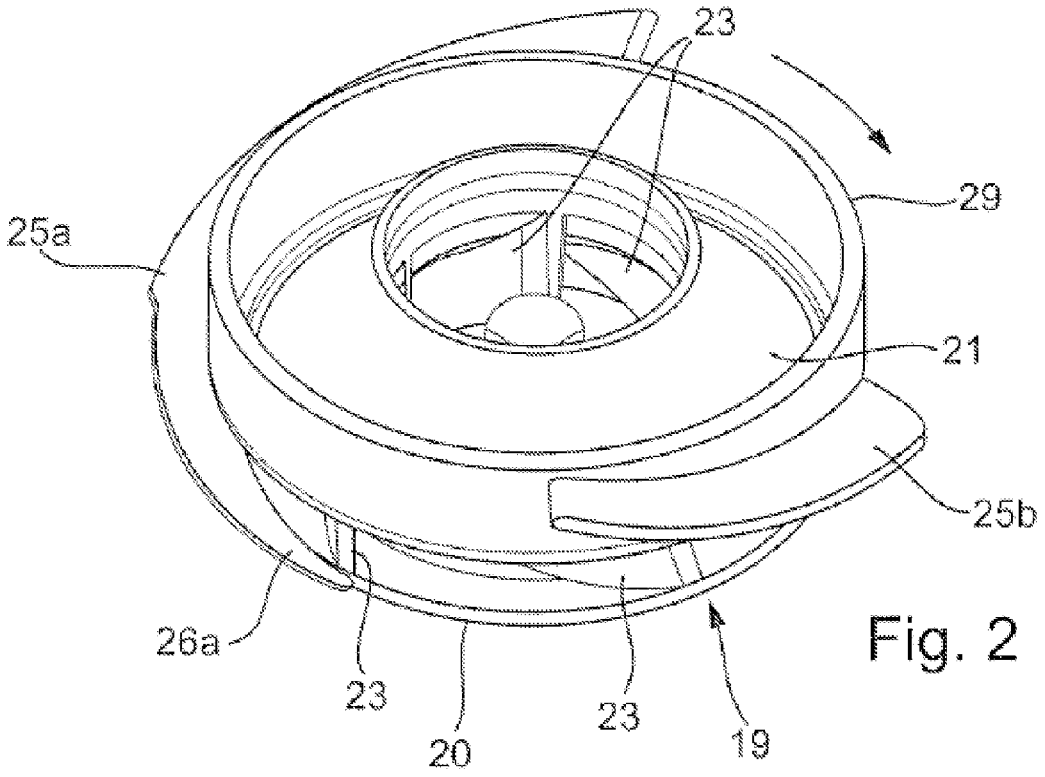
FIG. 2 shows an inclined view of a carrier ring with two flow directing blades thereon and the associated impeller corresponding to FIG. 1.

It can be seen from the inclined view in FIG. 2 how the flow directing blades 25*a* and 25*b* are arranged on the outside of the carrier ring 29 and extend at a recognizable pitch. As the impeller 19 with the bottom impeller disk 20, top impeller disk 21 and primary guide blades 23 in between rotates to the right quasi in a clockwise manner, as also in FIG. 4, the conveyed fluid runs in this same direction, in particular also when the aforementioned air bubbles are located therein. Above all, the fluid flow with the air bubbles therein runs along the outer pump base 15*b* and can be removed there by means of the abutting free bottom end 26*a* and by means of the flow directing blade 25*a* can be lifted and conveyed toward the discharge port 18 of the pump. The flow directing blade 25*b* also serves for said conveying-away so that the fluid flow is conveyed away from the pump base 15*b* also in the region of said flow directing blade. FIG. 5 shows a side view of this.

Figure 3:
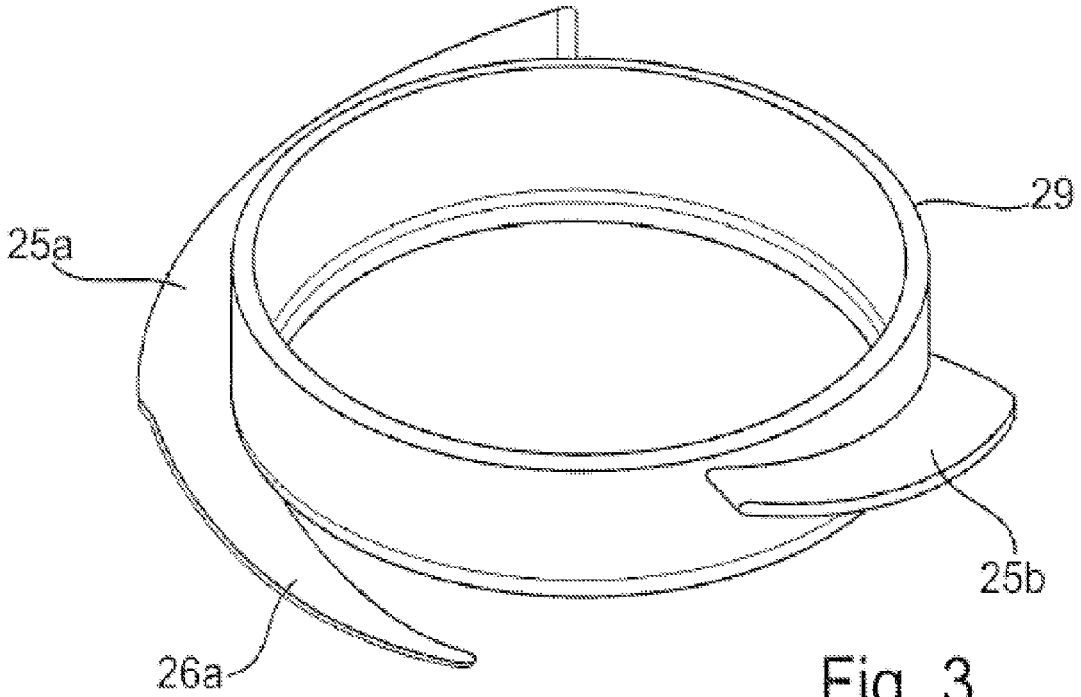
FIG. 3 shows the view of the carrier ring from FIG. 2 with the flow directing blades and no impeller.

The impeller 19 has been omitted from FIG. 3 for reasons of better clarity. The shape of the region of the flow directing blade 25*a*, which protrudes downward beyond the carrier ring 29, is easy to see as far as up to the free lower end 26*a*. The shape is provided in an advantageous manner such that the flow directing blade 25*a* abuts against the outer pump base 15*b* by way of the outer edge of the free region.

Figure 4:
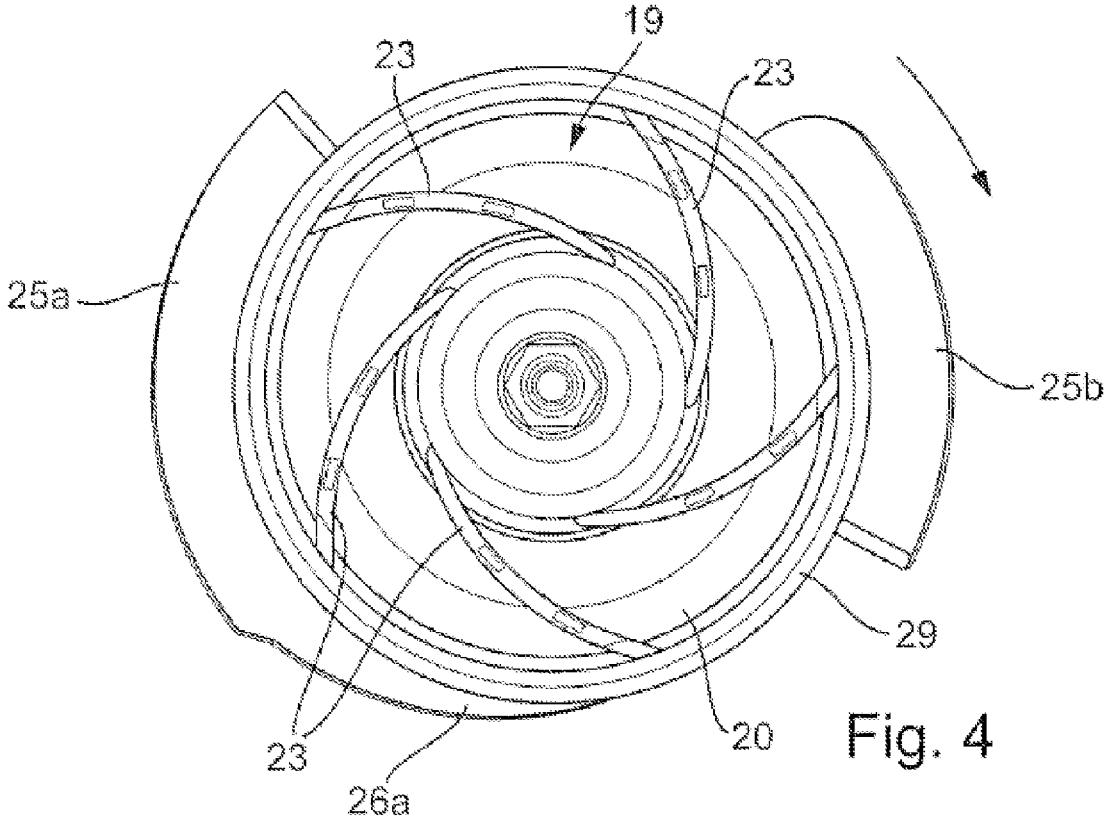
FIG. 4 shows a top view of the arrangement from FIG. 2.
Figure 5:
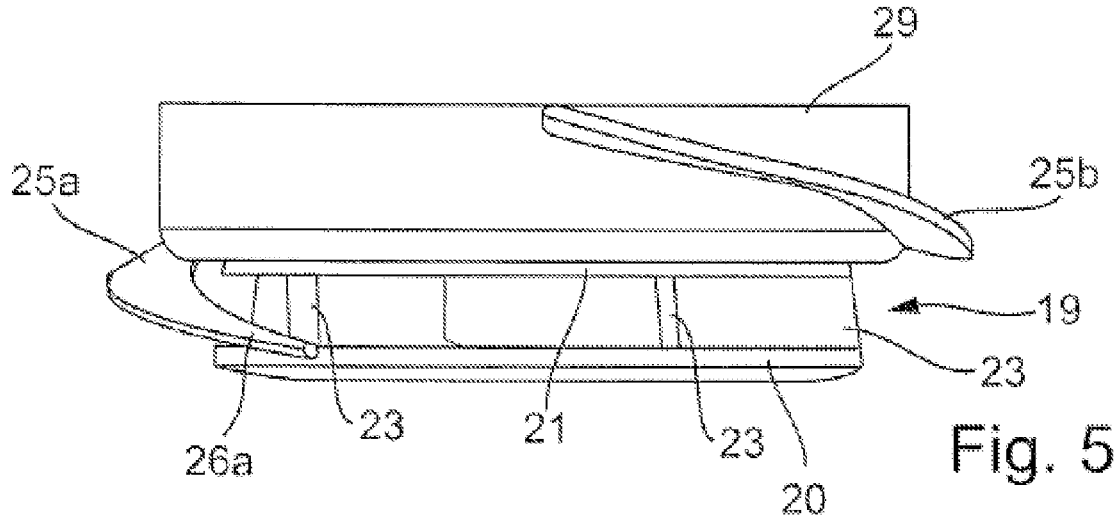
FIG. 5 shows a side view of the arrangement from FIG. 2

As can be seen from the top view in FIG. 4, the free lower end 26*a* of the flow directing blade 25*a* is situated together with the free section radially only slightly outside the impeller 19. The largest part or even the entire circulating funnel or tube produced from fluid or water with a plurality of air bubbles therein can actually be picked up in this way. The aforementioned spacing between the flow directing blade 25*a* or rather the free lower end 26*a* thereof and the bottom surface of the impeller 19 is approximately 3 mm or even a little less.

Figure 6:
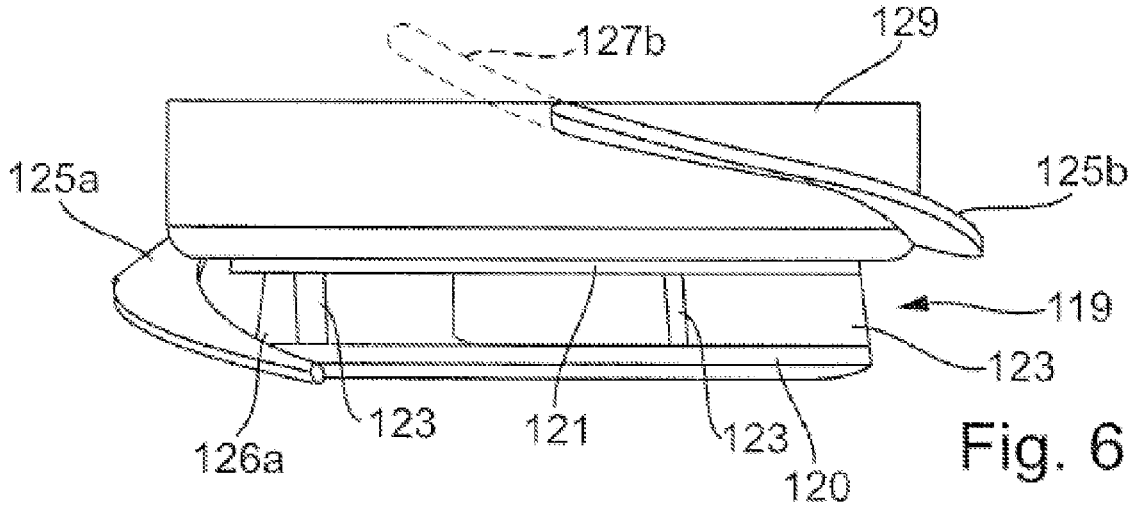
FIG. 6 shows a modification corresponding to the representation from FIG. 5 with a flow directing blade pulled further downward.

In the modification of the side view from FIG. 5, FIG. 6 shows as comparison how in the case of a flow directing blade 125*a* on a carrier ring 129 a bottom free end 126*a* is pulled even further downward, for example 1 mm to 20 mm or even more, and even protrudes beyond an impeller 119 or a bottom impeller disk 120. This can be an advantage in the case of pump bases provided differently to in FIG. 1. It is also possible to see a top impeller disk 121 and primary directing blades 123 which are provided in an identical manner. The afore-named spacing between the flow directing blade 125 and the bottom surface of the impeller 119 is a few mm, in an advantageous manner approximately 3 mm or even a little less.

In addition, shown by a broken line is how, in the case of a second flow directing blade 125*b*, an upper free end 127*b* as the aforementioned diverting section in the other direction is able to protrude freely beyond the carrier ring 129 and then, transferred to FIG. 1, brings about further improved guiding of the fluid flow toward the discharge port 18 of the pump 11. A projecting length in this direction can be longer or shorter than the projecting length of the free section of the other flow directing blade 125*a*. However, this depends substantially on the spatial conditions in a pump chamber.

The invention claimed is:

1. A pump comprising:

an impeller for conveying fluid to function as a centrifugal pump, where fluid may be conveyed to the pump in a central axial direction of the pump, and fluid may flow out in a radial direction from the pump; and a pump chamber having a pump base, wherein the impeller has a bottom surface and extends above the pump base, wherein one or more fixed flow directing blades are arranged radially outside the impeller in the pump chamber, said one or more fixed flow directing blades extending in a helicoidal configuration with a pitch extending in the rotational direction of the impeller away from the pump base, and wherein at least one of the one or more fixed flow directing blades extends proximate the bottom surface of the impeller.

2. The pump according to claim 1, wherein the at least one of the one or more fixed flow directing blades extends proximate a front of the pump base.

3. The pump according to claim 1, wherein the at least one of the one or more fixed flow directing blades borders on the pump base with a small gap.

4. The pump according to claim 1, wherein the at least one of the one or more fixed flow directing blades is arranged on a circumferential carrier ring extending substantially radially outside an upper region of the impeller, wherein the at least one of the one or more fixed flow directing blades projecting proximate the bottom surface of the impeller and protrudes beyond the circumferential carrier ring in the axial direction.

5. The pump according to claim 4, wherein only one of the one or more fixed flow directing blade protrudes beyond the circumferential carrier ring and extends to the bottom surface of the impeller.

6. The pump according to claim 4, wherein the impeller is closed at said bottom surface and a top surface, wherein the carrier ring does not cover a side discharge port of the impeller, wherein the one or more fixed flow directing blades cover the side discharge portion of the impeller and extend to the bottom surface of the impeller.

7. The pump according to claim 6, wherein the impeller is closed at said top surface by an upper cover on said top surface.

8. The pump according to claim 4, wherein one of the one or more fixed flow directing blades extend in a direction away from the pump base over the carrier ring and protrudes from and projects over the carrier ring.

9. The pump according to claim 8, wherein the one of the one or more fixed flow directing blades extends by way of a free-standing diverting section in the direction away from the pump base above the carrier ring and protrudes from and projects over the carrier ring.

10. The pump according to claim 9, wherein the one of the one or more fixed flow directing blades extend by way of the free-standing diverting section proximate to a discharge port of the pump.

11. The pump according to claim 1, wherein one of the one or more fixed flow directing blades being disposed around the impeller less than 180°.

12. The pump according to claim 1, wherein one of the one or more fixed flow directing blades being disposed around the impeller more than 90° and less than 160°.

13. The pump according to claim 1, wherein the at least one of the one or more fixed flow directing blades has an increasingly steep ascending angle as it extends away from the pump base.

14. The pump according to claim 1, wherein the pump base further includes a region extending upward and radially outside the impeller and extending in an angular manner and being radially spaced from the impeller, wherein the one or more fixed flow directing blades extends proximate the bottom surface of the impeller at a small spacing to the angled pump base region or abuts thereon.

15. The pump according to claim 1, wherein a free downwardly extending inflow section of one of the one or more fixed flow directing blades extends proximate to the bottom surface of the impeller and being tapered to a point.

16. The pump according to claim 15, wherein the free downwardly extending inflow section is approximately uniformly tapered to a point from a maximum width on the attachment on a carrier ring to a point on a free end of the free downwardly extending inflow section in the vicinity of the pump base or the bottom surface of the impeller.

17. The pump according to claim 1, wherein one of the one or more fixed flow directing blades extending to the bottom surface of the impeller being resilient and abutting against the pump base in a spring-loaded manner.

18. The pump according to claim 1, wherein one of the one or more fixed flow directing blades extends proximate to a discharge port of the pump.

* * * * *